US008621717B2

(12) United States Patent
Liermann

(10) Patent No.: US 8,621,717 B2
(45) Date of Patent: Jan. 7, 2014

(54) DOOR HINGE FOR A HIDDEN PLACEMENT BETWEEN A DOOR LEAF AND DOOR FRAME

(75) Inventor: Nicolas Liermann, Rheda-Wiedenbrueck (DE)

(73) Assignee: Simonswerk, Gesellschaft mit Beschraenkter Haftung, Rheda-Wiedenbrueck (DE)

( * ) Notice: Subject to any disclaimer, the term of this patent is extended or adjusted under 35 U.S.C. 154(b) by 0 days.

(21) Appl. No.: 13/463,201

(22) Filed: May 3, 2012

(65) Prior Publication Data

US 2012/0291225 A1 Nov. 22, 2012

(30) Foreign Application Priority Data

May 17, 2011 (DE) ..... 10 2011 050 413

(51) Int. Cl.
*E05D 3/06* (2006.01)

(52) U.S. Cl.
USPC ..... 16/364; 16/366

(58) Field of Classification Search
USPC ..... 16/235–238, 362–364, 242–246, 366, 16/368–370
See application file for complete search history.

(56) References Cited

U.S. PATENT DOCUMENTS

| | | | | |
|---|---|---|---|---|
| 3,596,307 | A * | 8/1971 | Kolmetsky | 16/237 |
| 4,817,241 | A * | 4/1989 | Koch et al. | 16/238 |
| 6,829,808 | B2 * | 12/2004 | Neukotter | 16/366 |
| 8,001,665 | B2 * | 8/2011 | Lehner | 29/11 |
| 8,196,265 | B2 * | 6/2012 | Neukoetter et al. | 16/389 |
| 8,413,299 | B2 * | 4/2013 | Bartels | 16/236 |
| 2010/0115729 | A1 * | 5/2010 | Neukoetter | 16/235 |
| 2010/0122431 | A1 * | 5/2010 | Neukoetter et al. | 16/238 |

FOREIGN PATENT DOCUMENTS

| | | |
|---|---|---|
| DE | 10 2008 056 327 | 4/2010 |
| DE | 10 2009 038 955 | 3/2011 |
| EP | 1 308 592 | 5/2003 |
| EP | 2 390 446 | 11/2011 |

* cited by examiner

*Primary Examiner* — Victor Batson
*Assistant Examiner* — Matthew Sullivan
(74) *Attorney, Agent, or Firm* — Michael J. Striker

(57) ABSTRACT

A door hinge is provided for a hidden placement between a door leaf and door frame. The door hinge has two recess elements that are insertable into recesses in the door frame and in the narrow side of the door leaf and two hinge brackets that are connected in articulating fashion. Each of the recess elements also has two guide elements that accommodate the ends of the hinge brackets. The guide elements each have a guide section with two sliding guides and two rotary seats. An end of a hinge bracket is secured in only one respective sliding guide and rotary seat, where the other sliding guide and the other rotary seat remain correspondingly unoccupied.

12 Claims, 4 Drawing Sheets

DOOR HINGE FOR A HIDDEN PLACEMENT BETWEEN A DOOR LEAF AND DOOR FRAME

CROSS REFERENCE TO RELATED APPLICATIONS

The invention described and claimed hereinbelow is also described in German Patent Application DE 10 2011 050413.3, filed on May 17, 2011. The German Patent Application, whose subject matter is incorporated by reference herein, provides the basis for a claim of priority of invention under 35 U.S.C. 119(a)-(d). Further, the content of the present application is related to the content of U.S. application Ser. No. 13/470,634, filed May 14, 2012.

BACKGROUND OF THE INVENTION

The invention relates to a door hinge for a hidden placement between a door leaf and door frame, formed with two recess elements that can be inserted into recesses in the door frame and in the narrow edge of the door leaf and with two hinge brackets that are connected in articulating fashion, the recess elements each formed with two guide elements that accommodate the ends of the hinge brackets.

A door hinge with the two recess elements and two hinge brackets is known from EP 1 308 592 A1. Each of the two hinge brackets is secured in rotary fashion in a rotary seat at its first end and is secured in a sliding guide in a manner that allows it to rotate and slide along the sliding guide at its other end. The two recess elements each have one guide element provided above the hinge brackets and one guide element provided below the hinge brackets. The two guide elements on the recess element attached to the door leaf and the two guide elements on the recess element attached to the door frame are embodied to be precisely mirror-symmetrical to each other with regard to the arrangement of a sliding guide and a rotary socket in the form of a hole. The two guide elements provided for a recess element must therefore be differently embodied. In a preferred manufacturing method using diecasting, it is therefore necessary to keep two different diecasting molds on hand.

Depending on the design of the door hinge, the same guide elements can be provided for the recess element mounted in the door leaf and for the recess element mounted in the door frame. But if the recess element mounted in the door leaf on the one hand and the recess element mounted in the door frame on the other are of different widths, or if differently shaped sliding guides are provided, then a total of four different guide elements must be produced. This results in an increased manufacturing expense. Particularly when manufactured by means of diecasting, having to provide four different diecasting molds is disadvantageous. It is also necessary to keep the parts precisely allocated with regard to their subsequent arrangement in the door hinge, which is a further disadvantage.

SUMMARY OF THE INVENTION

The present invention provides a door hinge that overcome shortcomings of the known arts.

In one embodiment, the invention provides a door hinge for hidden placement between a door leaf and door frame, which is particularly simple to manufacture.

The door hinge is formed with two recess elements that can be inserted into recesses in the door frame and in the narrow edge of the door leaf and with two hinge brackets that are connected in articulating fashion, the recess elements each formed with two guide elements that accommodate the ends of the hinge brackets. The guide section of each guide element is equipped with two sliding guides and two rotary seats, in particular holes, with the end of a hinge bracket secured in only one sliding guide and one rotary seat.

The other sliding guide and the other receiving hole remain correspondingly unoccupied. The guide elements are designed with the above-described embodiment in a way that permits them to be situated on both the left and right side, i.e., in a receiving element above the hinge brackets or, rotated by 180°, in a receiving element below the hinge brackets. At least the two guide elements of one recess element can be produced using the same mold, for example by means of diecasting, thus reducing the manufacturing cost. Also, when installing the door hinge, it is not necessary to keep the corresponding parts separate from each other, thus constituting a further simplification.

The above-described embodiment is particularly suited for door hinges in which each hinge bracket is secured in rotary fashion in one of the rotary seats at one end and is secured in a sliding guide of the guide element in the other recess element in a manner that allows it to rotate and slide along the sliding guide at its other end. In an alternative, one hinge bracket is secured only in rotary fashion in the rotary seats at both of its ends and the other hinge bracket is secured in the sliding guides at both of its ends.

In order to be able to use the guide elements on both the left and right sides, i.e. above and below the hinge brackets in one of the recess elements, in the guide elements, the two respective sliding guides on the one hand and the two respective rotary seats on the other are positioned in the guide section so that they are mirror-symmetrical relative to a center line.

Depending on the desired kinematics of the door hinge and, depending on the amount of installation space available in the door leaf and door frame, the two recess elements can be of different widths, or the sliding guides in their guide elements can follow different paths. This is advantageous in that two identical guide elements can be provided for each of the two recess elements.

In another embodiment, the guide sections are configured the same in all of the guide elements. This is possible when the recess element mounted to the door frame on the one hand and the recess element mounted to the door leaf on the other have the same width of guide element and the same path of their sliding guides. Such design is advantageous in that all of the guide elements can be produced in a single diecasting mold. It is thus possible, for example, for all of the guide elements to be produced from one congruent blank form. Depending on their placement in the recess element mounted in the door leaf or the recess element mounted in the door frame, different additional finishing steps can also be provided.

Since the guide elements are preferably adjustable relative to the recess elements, the corresponding blank form can have grooves, threads, or the like provided in it. These grooves, threads, or the like elements permit an adjustment to be made. It is also necessary to take into account the fact that it is useful to provide different adjustment directions and therefore also different adjustment means for the recess element mounted in the door leaf on the one hand and for the recess element mounted in the door frame on the other. This is why starting from one congruent blank form, different finishing work can be performed on the respective guide elements.

In order to be able to fasten the recess elements to the door leaf and the door frame, respectively, the recess elements are suitably provided with fastening sections at the ends. Preferably, the guide elements are situated in a vertically and/or horizontally adjustable fashion relative to the fastening sections of the recess element respectively associated with them. An adjustment in the vertical direction, i.e. parallel to a rotation axis of the door hinge, is necessary in order to adjust the height of the door hinge relative to the surface of a floor. It is thus possible to ensure that the door can move without jamming and at the same time, to avoid producing too large a gap along the underside of the door leaf, which would negatively impact both its visual appearance and its ability to provide a physical barrier.

In addition, the door leaf also is horizontally adjustable. A horizontal adjustment parallel to the surface of the door leaf makes it possible to adjust the rebate space, i.e., the lateral distance between the door frame and the door leaf on both sides of the door panel when the door leaf is closed. The corresponding adjustment is also referred to as lateral adjustment.

A horizontal adjustment perpendicular to the surface of the closed door leaf is referred to as a closing pressure adjustment. This adjustment makes it possible to set how tightly the closed door leaf rests against the frame. The closing pressure adjustment can be used, for example, to align the door leaf flush with a matching surface of the frame and/or to permit adjustment of the pressure exerted on a seal when a door leaf is closed.

In order to enable an adjustment, the guide elements can be provided, for example, with an oblong hole that extends in the vertical direction or horizontal direction depending on the desired adjustment. In order to permit a universal use, a subregion, in particular a central region of the oblong hole, can also have an expansion in the lateral direction in order to be able to accommodate a different adjusting means there, e.g. an adjusting screw. In order to accommodate the adjusting screw, starting from a blank form produced by diecasting, a separate processing step must be provided in order to cut a thread for the adjusting screw.

Another aspect of the present invention relates to the embodiment of the recess element.

According to the prior art, part of the recess element is a base plate that is frequently embodied in the form of a die cast component that is solid and therefore expensive to produce (EP 1 308 592 A2) or in the form of two head modules with a plate situated between them (DE 10 2008 056 327 B3). According to another embodiment of the invention, at least one of the recess elements has a base plate embodied in a single piece composed of sheet metal, with fastening sections at the ends and a middle section that connects the fastening sections. The sheet metal is comparatively easy to bend and stamp; the one-piece embodiment also produces a particularly high strength.

The fastening sections are situated at a front side of the recess element and the middle section is situated at its back side. The base plate has lateral struts serving as a transition from the middle section to the fastening sections and in the region of each of the lateral struts, a respective guide element is situated between the middle section and the respective fastening section. The respective guide element can be adjusted by means of a fixing and/or adjusting means. As a result, in a top view from the front, the fastening sections and the middle section overlap each other over approximately the entire length of the lateral struts. This forms a cross-sectionally U-shaped structure in which the fixing and/or adjusting means for the guide elements can be arranged and guided.

In order to permit multiple adjustments, parts that move relative to each other are suitably provided with guide means between them in the form of groove guides, oblong holes, or the like. In addition, however, it is also possible to provide adjusting means such as adjusting cams, adjusting screws, adjusting wedges, or the like.

Further details will become apparent from the exemplary embodiment depicted in the following. The invention is explained in greater detail in the following with reference to an example.

BRIEF DESCRIPTION OF THE DRAWING FIGURES

Further features and advantages of the invention will become apparent from the description of embodiments that follows, with reference to the attached figures. Shown are:

DETAILED DESCRIPTION OF THE PREFERRED EMBODIMENTS

The following is a detailed description of example embodiments of the invention depicted in the accompanying drawings. The example embodiments are presented in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

Figure 1:
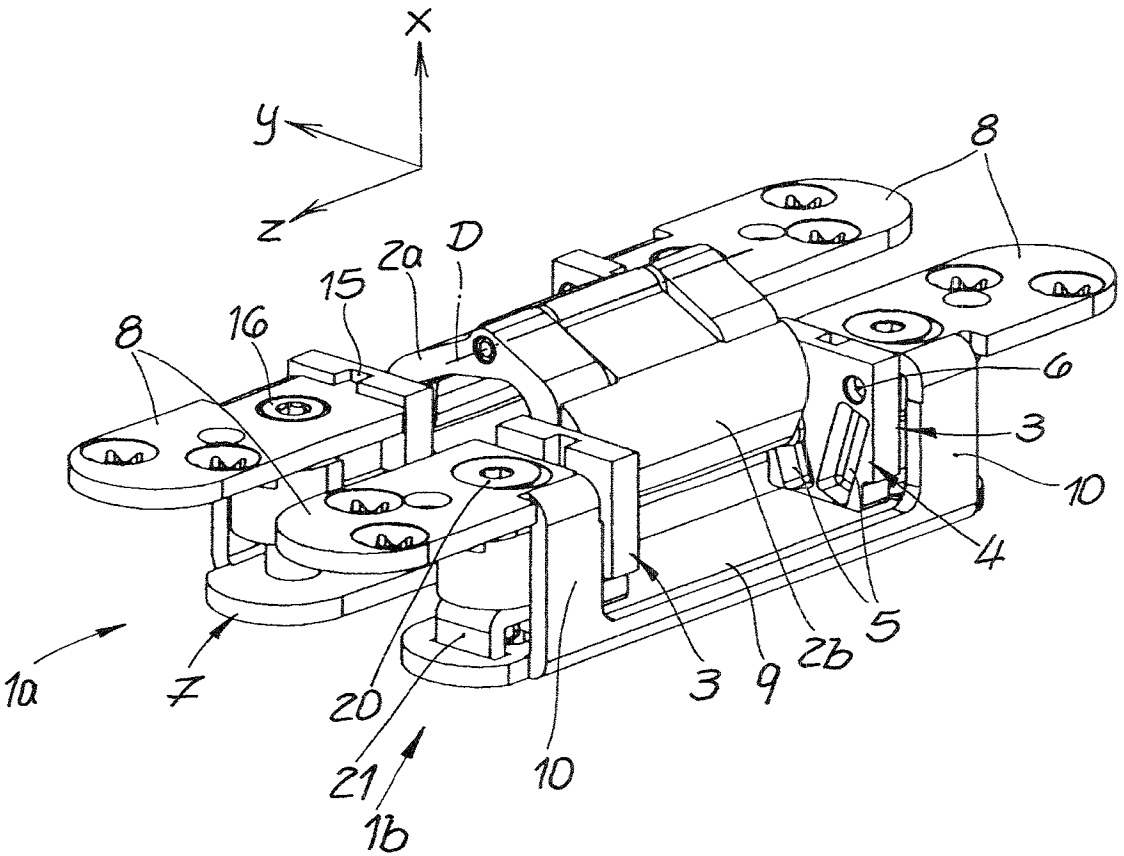
FIG. 1 is a perspective depiction of a door hinge according to the invention in an open position.

FIG. 1 depicts a door hinge configured for a hidden placement between a door leaf and door frame, which are not depicted for the sake of clarity. The door hinge has a first recess element 1*a* and a second recess element 1*b*, which are inserted into recesses in the door frame and in the narrow edge of a door leaf. The first and second recess elements 1*a*, 1*b* are connected to two hinge brackets 2*a*, 2*b* that are connected in articulating fashion at a rotation axis D. The first and second recess elements 1*a*, 1*b* each have two guide elements 3 that accommodate the ends of the hinge brackets 2*a*, 2*b*.

In the installed state of the door hinge, the rotation axis D extends in the vertical direction z.

FIG. 1 clearly shows that guide sections 4 of the guide elements 3 situated above and below the ends of the hinge brackets 2*a*, 2*b* in the vertical direction z each have one unoccupied sliding guide 5 and one unoccupied rotary seat 6 in the form of a hole.

Figure 3:
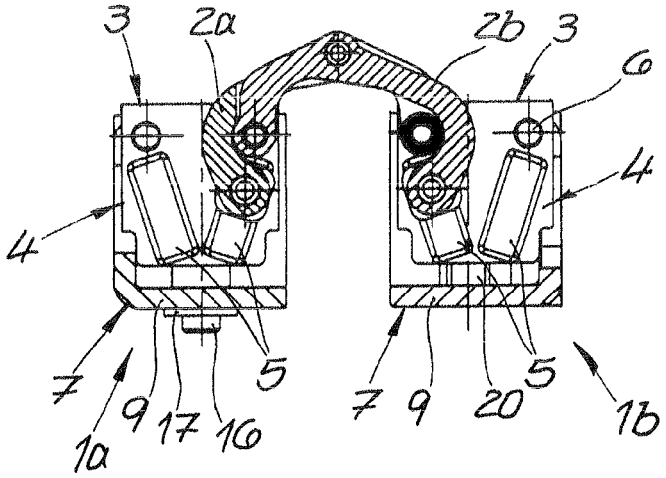
FIG. 3 is a section along the line A-A from FIG. 2.
Figure 4A:
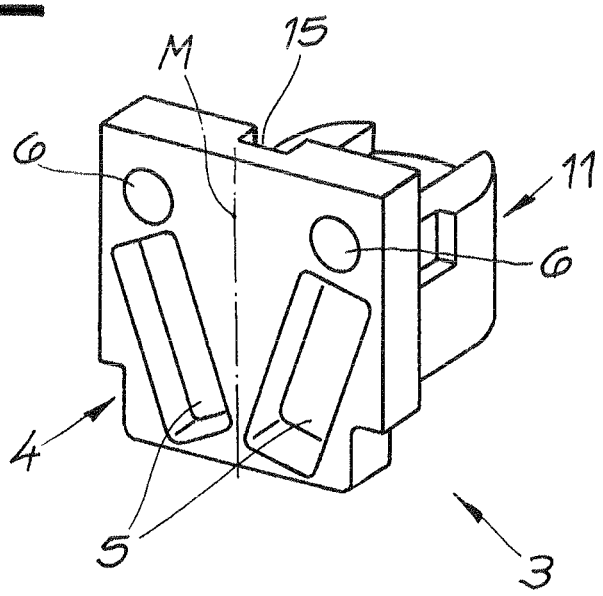
FIGS. 4A and 4B show different views of a guide element.

The kinematics of the door hinge and the purpose of the sliding guides 5 and rotary seats 6 are particularly evident from the depictions in FIG. 3 and FIG. 4A. As shown in these figures, each of the two hinge brackets 2*a* and 2*b* is guided in rotating fashion at its one end in a rotary seat 6 in one of the first and second recess elements 1*a*, 1*b*. At its other end, each of the two hinge brackets 2*a* and 2*b* is guided in rotating and longitudinally sliding fashion in a sliding guide 5 of the guide elements 3 of the other recess element 1*b*, 1*a*. The guide sections 4 have dual sliding guides 5 and dual rotary seats 6 to permit them to be used on the left or right, i.e. both above the hinge brackets 2*a*, 2*b* and, rotated by 180°, below the hinge brackets 2*a*, 2*b*. When rotated by 180°, there is then a reverse arrangement, which is why in each guide section, the two sliding guides 5 and two rotary seats 6 are arranged in mirror-symmetrical fashion relative to a center line M.

Depending on the design of the door hinge, the two receiving elements 1*a*, 1*b* can have differently shaped guide elements 3 in order to be fastened to the door leaf on the one hand and the door frame on the other. The figures depict an embodiment in which the guide sections 4 of all of the guide elements 3 are configured to be the same. The guide elements 3 may be precisely the same or can at least be produced from a congruent blank form. It is thus possible for the guide elements 3 to all be manufactured in the same shape by means of metal diecasting.

As such, it is then optionally possible to carry out a different final machining depending on their placement in the first recess element 1*a* or the second recess element 1*b*. A different final machining and/or a combination with other elements can be useful, for example, in order to achieve different kinds of movement of the guide elements 3 and therefore also of the hinge brackets 2*a*, 2*b* relative to the recess elements 1*a*, 1*b*.

As explained in detail below, in relation to the door leaf in its closed position, the door hinge shown in the exemplary embodiment permits an adjustment in the vertical direction z and in two horizontal directions x, y perpendicular thereto. This feature produces a door hinge that can be adjusted three-dimensionally in a particularly simple way.

FIG. 1 also shows that both the first and the second recess elements 1*a*, 1*b*, have a one-piece base plate 7 composed of sheet metal and equipped with fastening sections 8 at the ends and a middle section 9 that connects the fastening sections 8. The base plate 7 is produced in a particularly simple fashion by bending, stamping, and drilling and nevertheless has a high degree of stability and strength. The fact that the entire base plate 7 is composed of a single piece also contributes to its stability and strength.

The fastening sections 8 situated at the front side of the first and the second recess elements 1*a*, 1*b*, and the middle section 9 situated on its back side overlap each other in the vertical direction z. In the overlapping region, the fastening sections 8 are connected to the middle section 9 by means of lateral struts 10. The lateral struts 10, together with the respective fastening sections 8 and the middle section 9, constitute an essentially U-shaped region. The guide elements 3 are situated in this U-shaped region.

The arrangement of the guide elements 3 will be explained in detail below. The essential factor is that from the time of their manufacture, the guide elements 3 already have adapted shapes that permit them to be situated in both the first recess element 1*a* and the second recess element 1*b* and to be adjusted in various directions.

Figure 4B:
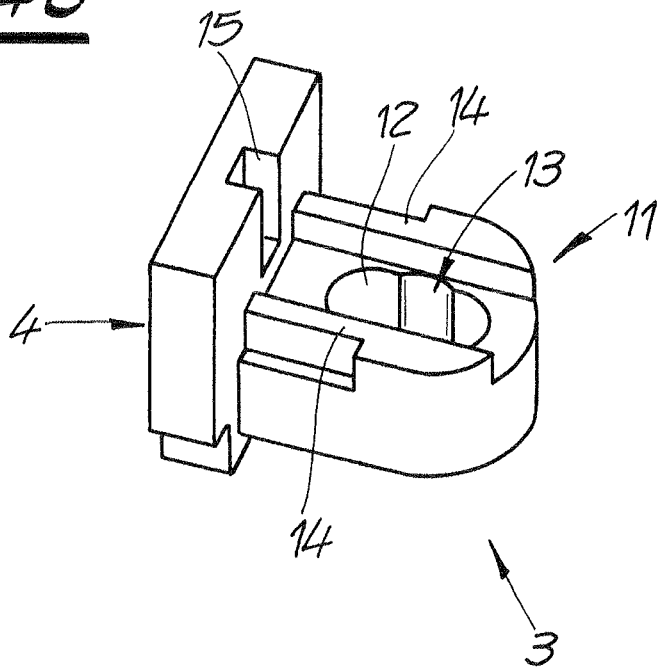

It is clear from FIG. 4B that the guide elements 3, on a part 11 opposite from the guide section 4, have an oblong hole 12 extending in the vertical direction. The oblong hole 12 has a lateral expansion in a central region 13. FIG. 4B also shows that the part 11 opposite from the guide section 4 has protrusions 14 that are provided for guidance purposes. Finally, a groove 15 also is provided on the back of the guide section 4.

Figure 2:
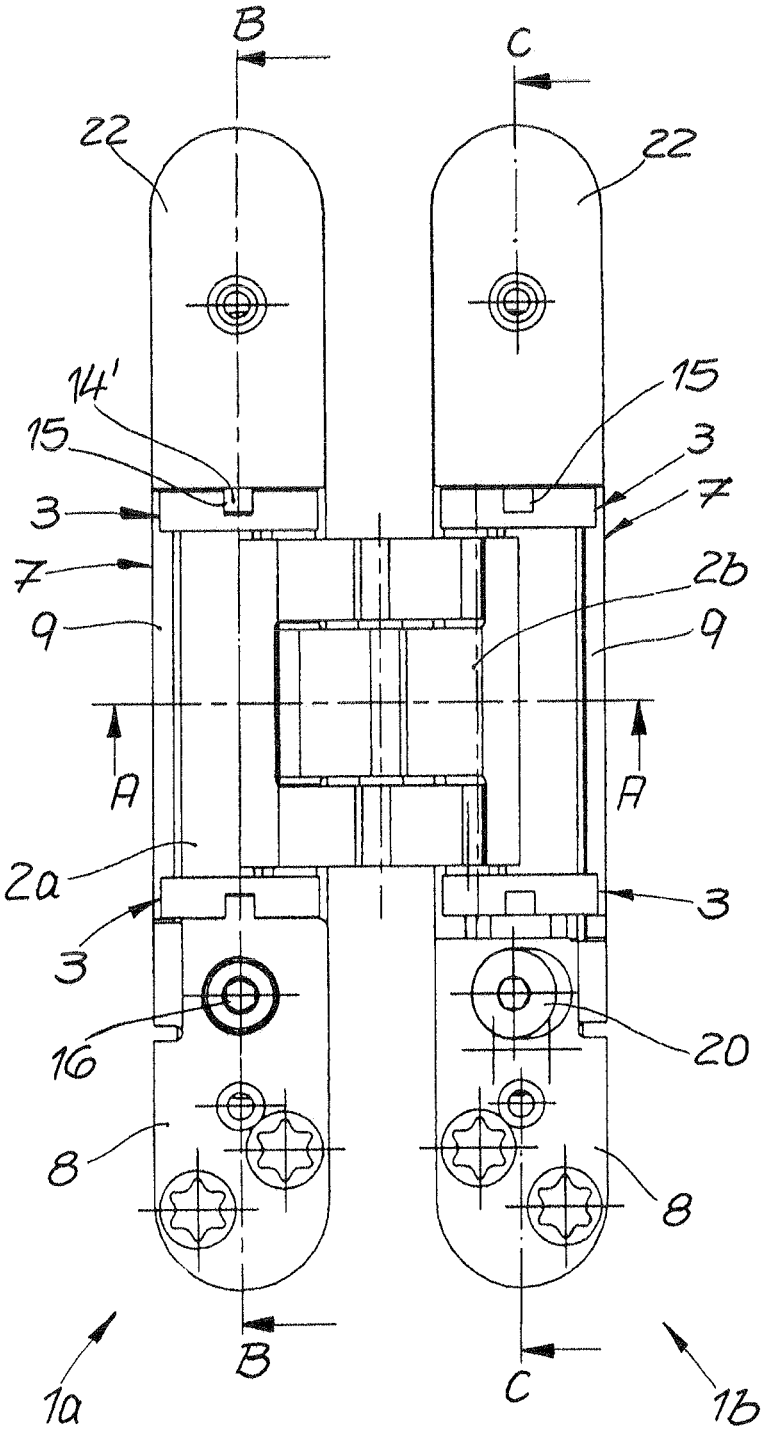
FIG. 2 is a top view of the door hinge according to FIG. 1.

As is clear from a comparison of FIGS. 1 and 2, the groove 15 is provided to guide the guide elements 3 of the first recess element 1*a* in a first horizontal direction x perpendicular to the fastening sections 8.

Figure 5A:
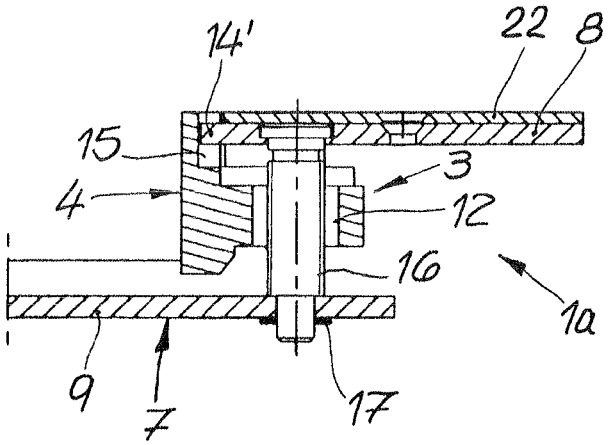
FIG. 5A is a section along the line B-B from FIG. 2.

A sectional depiction in FIG. 5A shows that an adjusting means in the form of an adjusting screw 16 also is provided. The adjusting screw 16 is supported with a head in the fastening section 8 and with a foot and a securing washer in the middle section 9. The adjusting screw 16 is matched to the diameter of the oblong hole 12 at the expansion in its middle region 13. At least in the guide elements 3 of the first recess element 1*a*, this middle region 13 is provided with a corresponding internal thread that cooperates with the adjusting screw 16. When the adjusting screw 16 is turned, the guide elements 3 are guided along the first horizontal direction x relative to the base plate 7, which has a projection 14' with which it engages in the groove 15 on the back side of the guide section 4.

On the second recess element 1*b*, however, an adjustment is provided in the vertical direction z and in a second horizontal direction y. According to FIG. 5B, the second recess element 1*b* is provided with an intermediate piece 18 between the guide element 3 and the base plate 7 composed of sheet metal. The intermediate piece 18 has pins 19 on top that engage in a groove 15' of the associated fastening section. On the underside of the intermediate piece 18 that rests against the guide element 3, grooves are provided (not shown in the figures), which cooperate with the protrusions 14 of the guide elements 3 shown in FIG. 4B and provide guidance in the vertical direction.

A screw 20 provided for fixing purposes reaches through the fastening section 8, the intermediate piece 18, and the guide element 3 and engages in a threaded piece 21. The threaded piece 21 can be supported on the middle section 9 of the base plate 7. However, in order to permit an adjustment, a certain amount of play is suitably provided in the second horizontal direction y. There are various conceivable embodiments, however, with regard to the adjustment in the second horizontal direction y.

That is, the screw 20 can be arranged without play either on the fastening section 8 or the intermediate piece 18. The, the respective other part must be provided with an oblong hole. For example if, contrary to the depiction in FIG. 1, it is not possible to move the screw 20 relative to the fastening section 8 in the second horizontal direction y, then the intermediate piece 18 must have a corresponding oblong hole extending in the second horizontal direction y. In such an embodiment, however, the threaded piece 21 also can be supported on the middle section 9 without play in the second horizontal direction y.

Figure 5B:
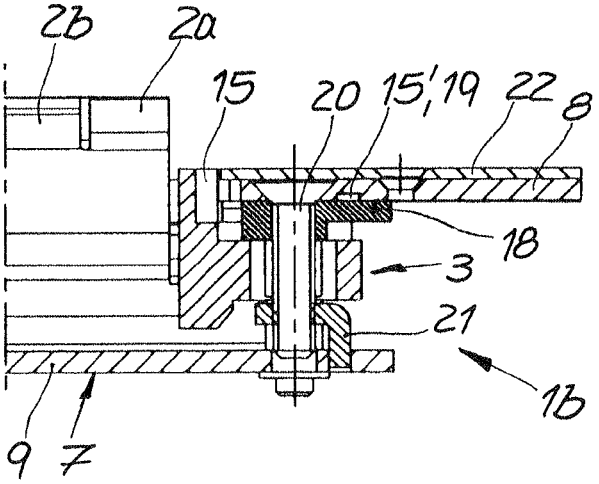
FIG. 5B is a section along the line C-C from FIG. 2.

FIGS. 2, 5A, and 5B show that as an optional accessory, cover plates 22 can be provided on the fastening sections 8 in order to hide the adjusting screws 16 provided for adjustment, the screws 20, and the fastening screws for connecting the recess elements 1*a* and 1*b* to the door frame or the door leaf.

As will be evident to persons skilled in the art, the foregoing detailed description and figures are presented as examples of the invention, and that variations are contemplated that do not depart from the fair scope of the teachings and descriptions set forth in this disclosure. The foregoing is not intended to limit what has been invented, except to the extent that the following claims so limit that.

What is claimed is:

1. A door hinge for a hidden placement between a door leaf and door frame, having two recess elements that are respectively insertable into recesses in the door frame and in the narrow side of the door leaf, two hinge brackets each of which has two ends pivotally connecting said recess elements, wherein the hinge brackets are connected to each other in articulating fashion, wherein each of said recess elements include two guide elements that accommodate one of the ends of each of the hinge brackets, wherein the guide elements each have a guide section with two sliding guides and two rotary seats, and wherein one end of one of the hinge brackets is secured in only one of the two sliding guides of each guide section, and one end of the other one of the brackets is secured in only one of the two rotary seats of each guide section.

2. The door hinge as recited in claim 1, wherein each hinge bracket (2*a*, 2*b*) is secured in rotary fashion in a rotary seat (6) at one of the ends and at another of the ends is secured in a sliding guide (5) in a manner that allows the hinge bracket to rotate and slide along the sliding guide (5).

3. The door hinge as recited in claim 1, wherein in each guide element (3), the two sliding guides (5) and the two rotary seats (6) are positioned on the guide section (4) so that they are mirror-symmetrical relative to a center line (M).

4. The door hinge as recited in claim 1, wherein the respective guide elements (3) in the recess elements (1*a*, 1*b*) are configured to be the same.

5. The door hinge as recited in claim 1, wherein all of the guide sections (4) of the guide elements (3) are configured to be the same.

6. The door hinge as recited in claim 1, wherein all of the guide elements (3) are configured to be the same or are produced from a congruent blank form.

7. The door hinge as recited in claim 1, wherein the guide elements (3) are produced by means of die casting.

8. The door hinge as recited in claim 1, wherein the recess elements (1*a*, 1*b*) have fastening sections (8) at the ends for fastening to the door leaf or door frame and the guide elements (3) are adjustably arranged relative to the fastening sections (8) of the associated recess elements (1*a*, 1*b*).

9. The door hinge as recited in claim 8, wherein the guide elements (3) are adjustably arranged so that it is possible to position the door leaf in the vertical direction (z) relative to the door frame and in two horizontal directions (x, y) that are perpendicular to each other with regard to a closed position of the door leaf.

10. A door hinge for a hidden placement between a door leaf and door frame, having two recess elements that are respectively insertable into recesses in the door frame and in the narrow side of the door leaf, and two hinge brackets each of which has two ends pivotally connecting said recess elements, wherein the hinge brackets are connected to each other in articulating fashion, wherein each of said recess elements include two guide elements that accommodate one of the ends of each of the hinge brackets, wherein the guide elements each have a guide section with two sliding guides and two rotary seats, and wherein one end of one of the hinge brackets is secured in only one of the two sliding guides of each guide section, and one end of the other one of the brackets is secured in only one of the two rotary seats of each guide section, wherein the recess elements have fastening sections at the ends for fastening to the door leaf or door frame and the guide elements are adjustably arranged relative to the fastening sections of the associated recess elements, and wherein the guide elements have an oblong hole extending in the vertical direction and the oblong hole has a lateral expansion in a middle region.

11. The door hinge as recited in claim 10, wherein at least one of the recess elements (1*a*, 1*b*) has a one-piece base plate (7) composed of sheet metal and equipped with fastening sections (8) at the ends and a middle section (9) that connects the fastening sections (8).

12. The door hinge as recited in claim 11, wherein the fastening sections (8) are situated at a front side of the recess element (1*a*, 1*b*) and the middle section (9) is situated at its back side; wherein the base plate (7) has lateral struts (10) serving as a transition from the middle section (9) to the fastening sections (8); and wherein in the region of each of the lateral struts (10), a respective guide element (3) is situated between the middle section (9) and the associated fastening section (8) and is adjustable by means of a fixing and/or adjusting means.

* * * * *